US012454648B2

(12) United States Patent
Liu et al.

(10) Patent No.: US 12,454,648 B2
(45) Date of Patent: Oct. 28, 2025

(54) PROCESSES FOR PRODUCING MESOPHASE PITCH

(71) Applicant: ExxonMobil Chemical Patents Inc., Baytown, TX (US)

(72) Inventors: Yifei Liu, Houston, TX (US); Stephen T. Cohn, Spring, TX (US); Jeffrey C. Yeh, Houston, TX (US); Teng Xu, Houston, TX (US)

(73) Assignee: ExxonMobil Chemical Patents Inc., Spring, TX (US)

( * ) Notice: Subject to any disclaimer, the term of this patent is extended or adjusted under 35 U.S.C. 154(b) by 178 days.

(21) Appl. No.: 18/260,761

(22) PCT Filed: Jan. 4, 2022

(86) PCT No.: PCT/US2022/011096

§ 371 (c)(1),
(2) Date: Jul. 7, 2023

(87) PCT Pub. No.: WO2022/155029

PCT Pub. Date: Jul. 21, 2022

(65) Prior Publication Data

US 2024/0059976 A1 Feb. 22, 2024

Related U.S. Application Data

(60) Provisional application No. 63/138,051, filed on Jan. 15, 2021.

(51) Int. Cl.

| | |
|---|---|
| ***C10C 3/08*** | (2006.01) |
| ***C10C 3/00*** | (2006.01) |
| ***D01F 9/155*** | (2006.01) |

(52) U.S. Cl.
CPC ..... *C10C 3/08* (2013.01); *C10C 3/002* (2013.01); *D01F 9/155* (2013.01)

(58) Field of Classification Search
CPC ..... C10C 3/002; C10C 3/08; D01F 9/155
See application file for complete search history.

(56) References Cited

U.S. PATENT DOCUMENTS

| | | | | |
|---|---|---|---|---|
| 4,208,267 | A | 6/1980 | Diefendorf et al. | 208/22 |
| 4,402,928 | A | 9/1983 | Lewis et al. | |

(Continued)

FOREIGN PATENT DOCUMENTS

| | | |
|---|---|---|
| JP | S6126692 A | 2/1986 |
| WO | WO2022/216850 | 10/2022 |
| WO | WO2022/231910 | 11/2022 |

OTHER PUBLICATIONS

Edie, D. D. et al. (1989) "Carbon Fiber Manufacturing," *Carbon-Carbon Materials and Composites,* v.27(5), 21 pgs.

(Continued)

*Primary Examiner* — Ellen M McAvoy
*Assistant Examiner* — Chantel Graham
(74) *Attorney, Agent, or Firm* — C. Tumey Law Group PLLC

(57) ABSTRACT

Processes are described for producing mesophase pitch. The processes generally comprise providing a feedstock having a T5≥400° F. (204° C.) and a T95≤1,400° F. (760° C.) and heating the feedstock at a temperature ranging from about 420° C. to about 520° C. to produce a heat treated product including isotropic pitch. Generally, the heating is conducted under conditions sufficient to satisfy the relationship [X*Y] ≥20,000 seconds, wherein X is the equivalent reaction time of the heating, and wherein Y is the bromine number of the feedstock as measured in accordance with ASTM D1159. The processes generally further comprise contacting the isotropic pitch with a solvent having a Solubility Blending number ($S_{BN}$) of at least about 10 SU under conditions sufficient to produce a solvent fraction comprising the (Continued)

solvent and an insoluble fraction comprising mesophase pitch, and recovering the mesophase pitch.

20 Claims, 2 Drawing Sheets

(56) References Cited

U.S. PATENT DOCUMENTS

| | | | | |
|---|---|---|---|---|
| 5,032,250 | A | 7/1991 | Romine et al. | 208/39 |
| 5,259,947 | A | 11/1993 | Kalback et al. | 208/44 |
| 5,489,374 | A * | 2/1996 | Romine | C10C 3/002 208/45 |
| 8,105,479 | B2 | 1/2012 | Ou et al. | 208/44 |
| 9,222,027 | B1 | 12/2015 | Malone et al. | |
| 9,376,626 | B1 | 6/2016 | Malone et al. | |
| 2019/0382665 | A1 | 12/2019 | Sorensen | |
| 2020/0071627 | A1 | 3/2020 | Xu et al. | |
| 2020/0181497 | A1 | 6/2020 | Brown et al. | |

OTHER PUBLICATIONS

Saudi Arabian Office Action for SA Patent Application No. 523441589 dated Apr. 20, 2024. English Translation with Original Untranslated Version, PDF file. 12 pages.

* cited by examiner

PROCESSES FOR PRODUCING MESOPHASE PITCH

CROSS REFERENCE TO RELATED APPLICATIONS

This application is a national stage filing of Patent Cooperation Treaty Application No. PCT/US2022/011096 filed Jan. 4, 2022, which claims the benefit of and priority to U.S. Provisional Application No. 63/138,051 filed Jan. 15, 2021, the disclosure of 63/138,051 is incorporated herein by reference.

FIELD

The present disclosure relates the production of mesophase pitch, typically for use in production of carbon fiber.

BACKGROUND

Isotropic pitch and mesophase pitch are carbon-containing feedstocks that can be formed from residues generated during processing of coal or petroleum feedstocks or by other methods, such as acid catalyzed condensation of small aromatic species. For some grades of carbon fiber, isotropic pitch can be used as an initial feedstock. However, carbon fibers produced from isotropic pitch generally exhibit little molecular orientation and relatively poor mechanical properties. In contrast to carbon fibers formed from isotropic pitch, carbon fibers produced from mesophase pitch exhibit highly preferred molecular orientation and relatively excellent mechanical properties. It would therefore be desirable to identify systems and/or methods that can improve the ability to produce mesophase pitch suitable for producing carbon fiber.

U.S. Pat. No. 4,208,267 describes methods for forming a mesophase pitch. An isotropic pitch sample is solvent extracted. The extract is then exposed to elevated temperatures in the range of 230° C. to about 400° C. to form a mesophase pitch.

U.S. Pat. No. 5,032,250 describes processes for isolating mesophase pitch. An isotropic pitch containing mesogens is combined with a solvent and subjected to dense phase or supercritical conditions and the mesogens are phase separated.

U.S. Pat. No. 5,259,947 describes a method for forming a solvated mesophase comprising: (1) combining a carbonaceous aromatic isotropic pitch with a solvent; (2) applying sufficient agitation and sufficient heat to cause the insoluble materials in said combination to form suspended liquid solvated mesophase droplets; and (3) recovering the insoluble materials as solid or fluid solvated mesophase.

Other potential references of interest include U.S. Pat. No. 9,222,027, US Pat. Pub. 2019/0382665, and US Pat. Pub. 2020/0181497.

SUMMARY

Figure 1:
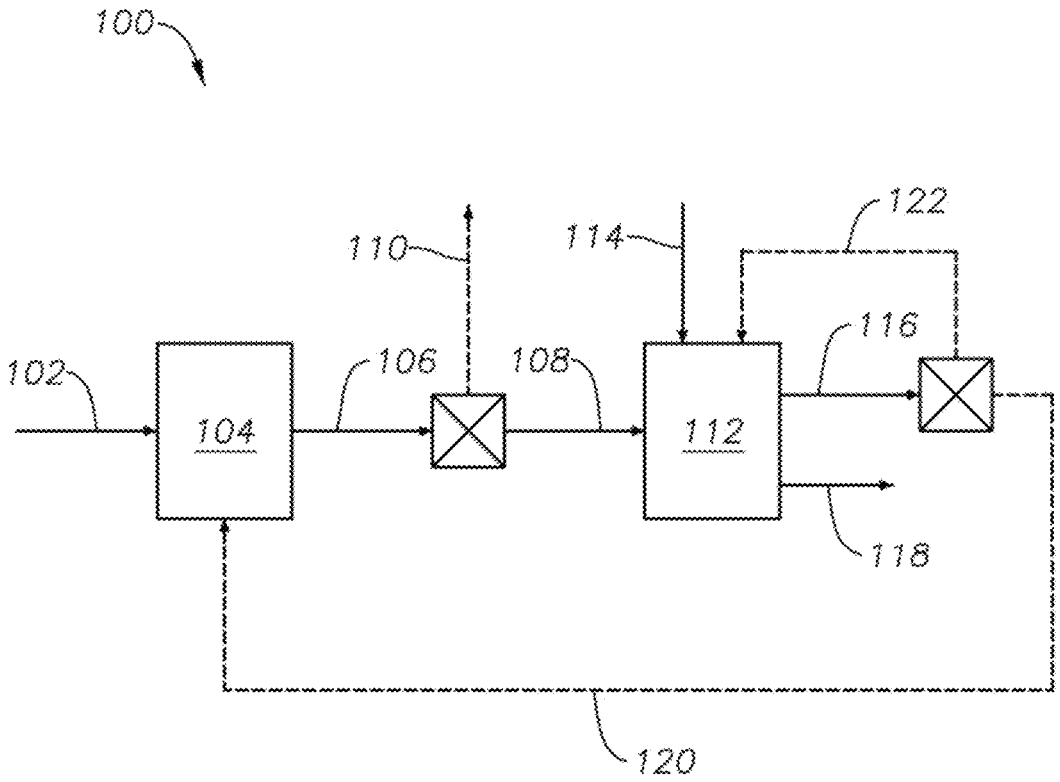
FIG. 1 is a diagram of a nonlimiting example of a process of the present disclosure.

According to the present disclosure, it has now been found that heat treating a heavy feedstock under sufficiently severe conditions in relation to the bromine number of the feedstock advantageously allows for increased formation of mesophase pitch precursor molecules that can then develop into mesophase agglomerates through solvent extraction.

Thus, in one aspect, the present disclosure relates to a process for producing mesophase pitch, the process comprising: providing a feedstock having a T5≥400° F. (204° C.) and a T95≤1,400° F. (760° C.); heating the feedstock at a temperature ranging from about 420° C. to about 520° C. to produce a heat treated product including isotropic pitch, wherein the heating is conducted under conditions sufficient to satisfy the relationship [X*Y]≥20,000 seconds, wherein X is the equivalent reaction time of the heating, and wherein Y is the bromine number of the feedstock as measured in accordance with ASTM D1159; contacting the isotropic pitch with a solvent having a Solubility Blending number ($S_{BN}$) of at least about 10 SU under conditions sufficient to produce a solvent fraction comprising the solvent and an insoluble fraction comprising mesophase pitch; and recovering the mesophase pitch.

In a further aspect, the present disclosure relates to a mesophase pitch produced by the foregoing process.

In a further aspect, the present disclosure relates to a carbon fiber produced from the foregoing mesophase pitch.

In yet another aspect, the present disclosure relates to a process for producing mesophase pitch, the process comprising: providing a feedstock comprising at least one member selected from the group consisting of main column bottoms (MCB), hydroprocessed MCB, steam cracker tar, hydrotreated steam cracker tar, vacuum resid, deasphalted residue or rock, and mixtures or combinations thereof, heating the feedstock at a temperature ranging from about 420° C. to about 520° C. to produce a heat treated product including isotropic pitch, wherein the heating is conducted under conditions sufficient to satisfy the relationship [X*Y] ≥20,000 seconds, wherein X is the equivalent reaction time of the heating, and wherein Y is the bromine number of the feedstock as measured in accordance with ASTM D159; contacting the isotropic pitch with a solvent selected from the group consisting of single-ring aromatics, two-ring aromatics, paraffins, a midcut solvent, and mixtures or combinations thereof under conditions sufficient to produce a solvent fraction comprising the solvent and an insoluble fraction comprising mesophase pitch; and recovering the mesophase pitch.

DETAILED DESCRIPTION OF THE PREFERRED EMBODIMENTS

Various embodiments described herein provide processes for the production of mesophase pitch via solvent extraction of an isotropic pitch formed by heat treating at sufficiently severe conditions a heavy feedstock having a T5≥400° F. (204° C.) and a T95≤1,400° F. (760° C.). Without wishing to be bound by theory, it is believed that employing a deasphalting solvent having a Solubility Blending Number ($S_{BN}$) of least 10 solvency units ("SU") advantageously allows for dissolution of low hydrogen content, large aromatic molecules in the isotropic pitch while not disrupting the development of mesophase agglomerates. Generally, the heat treatment of the heavy feedstock is conducted at a temperature ranging from about 420° C. to about 520° C. and a residence time of 5 minutes to 8 hours, more preferably from about 5 minutes to about an hour, and most preferably from 5 minutes to 30 minutes, such as about 10 minutes to about 30 minutes. Without wishing to be bound by theory, it is believed that conducting the heat treatment of the heavy feedstock at a sufficiently high severity relative to the reactivity of the heavy feedstock as measured by its bromine number advantageously results in the increased formation of mesophase pitch precursor molecules that can then develop into mesophase agglomerates through solvent extraction, thereby increasing the mesophase pitch yield in the solid product recovered from the insoluble fraction.

All numerical values within the detailed description and the claims herein are modified by "about" or "approximately" the indicated value, and take into account experimental error and variations that would be expected by a person having ordinary skill in the art. Unless otherwise indicated, room temperature is about 23° C.

As used herein, "wt %" means percentage by weight, "vol %" means percentage by volume, "mol %" means percentage by mole, "ppm" means parts per million, and "ppm wt" and "wppm" are used interchangeably to mean parts per million on a weight basis. All "ppm" as used herein are ppm by weight unless specified otherwise. All concentrations herein are expressed on the basis of the total amount of the composition in question. All ranges expressed herein should include both end points as two specific embodiments unless specified or indicated to the contrary.

Definitions

For the purpose of this specification and appended claims, the following terms are defined.

As used herein, the term "asphaltene" refers to material obtainable from crude oil and having an initial boiling point above 1,200° F. (650° C.) and which is insoluble in straight chain alkanes such as hexane and heptanes, i.e., paraffinic solvents.

As used herein, the term "equivalent reaction time (ERT)" refers to the severity of an operation, expressed as seconds of residence time for a reaction having an activation energy of 54 kcal/mol in a reactor operating at 468° C. The ERT of an operation is calculated as follows:

$$ERT = W \times \frac{e^{\left(-\frac{E_a}{R \times (T_{rxn})}\right)}}{e^{\left(-\frac{E_a}{R \times (741K)}\right)}}$$

where W is the residence time of the operation in seconds; e is 2.71828; $E_a$ is 225,936 J/mol; R is 8.3145 $J \cdot mol^{-1} \cdot K^{-1}$; and $T_{rxn}$ is the temperature of the operation expressed in Kelvin. In very general terms, the reaction rate doubles for every 12 to 13° C. increase in temperature. Thus, 60 seconds of residence time at 468° C. is equivalent to 60 ERT, and increasing the temperature to 501° C. would make the operation five times as severe, i.e. 300 ERT. Expressed in another way, 300 seconds at 468° C. is equivalent to 60 seconds at 501° C., and the same product mix and distribution should be obtained under either set of conditions.

As used herein, the term "pitch" refers to a viscoelastic carbonaceous residue obtained from distillation of petroleum, coal tar, or organic substrates. Unless otherwise specified herein, the term "pitch" refers to petroleum pitch (i.e., pitch obtained from distillation of petroleum).

As used herein, the term "isotropic pitch" refers to pitch comprising molecules which are not aligned in optically ordered liquid crystals.

As used herein, the term "main column bottoms (MCB)" refers to a bottoms fraction from a fluid catalytic cracking process.

As used herein, the term "mesogens" refers to mesophase pitch-forming materials or mesophase pitch precursors.

As used herein, the term "mesophase pitch" refers to pitch that is a structurally ordered optically anisotropic liquid crystal. Mesophase structure can be described and characterized by various techniques such as optical birefringence, light scattering, or other scattering techniques.

As used herein, the term "midcut solvent" refers to a recycled portion of a product generated during upgrading of steam cracker tar, wherein such recycled portion has an atmospheric boiling range from about 350° F. (177° C.) to about 850° F. (454° C.).

Test Methods

Solubility Blending Number ($S_{BN}$) and Insolubility Number ($I_N$)

The SU values corresponding to the Solubility Blending Number ($S_{BN}$) and the insolubility number ($I_N$) are values that can be used to characterize the solubility properties of the deasphalting solvents described herein.

The first step in determining the Insolubility Number and the Solubility Blending Number for the deasphalting solvents described herein is to establish if the deasphalting solvent contains n-heptane insoluble asphaltenes. This is accomplished by blending 1 volume of the deasphalting solvent with 5 volumes of n-heptane and determining if asphaltenes are insoluble. Any convenient method might be used. One possibility is to observe a drop of the blend of test liquid mixture and deasphalting solvent between a glass slide and a glass cover slip using transmitted light with an optical microscope at a magnification of from 50 to 600×. If the asphaltenes are in solution, few, if any, dark particles will be observed. If the asphaltenes are insoluble, many dark, usually brownish, particles, usually 0.5 to 10 microns in size, will be observed. Another possible method is to put a drop of the blend of test liquid mixture and deasphalting solvent on a piece of filter paper and let dry. If the asphaltenes are insoluble, a dark ring or circle will be seen about the center of the yellow-brown spot made by the solvent. If the asphaltenes are soluble, the color of the spot made by the solvent will be relatively uniform in color. If the deasphalting solvent is found to contain n-heptane insoluble asphaltenes, the procedure described in the next three paragraphs is followed for determining the Insolubility Number and the Solubility Blending Number. If the deasphalting solvent is found not to contain n-heptane insoluble asphaltenes, the Insolubility Number is assigned a value of zero and the Solubility Blending Number is determined by the procedure described in the section labeled, "Deasphalting Solvents without Asphaltenes".

Asphaltene Containing Deasphalting Solvents

The determination of $I_N$ and $S_{BN}$ for a deasphalting solvent containing asphaltenes, such as a heavy oil comprising resid, requires testing the solubility of the deasphalting solvent in test liquid mixtures at the minimum of two volume ratios of deasphalting solvent to test liquid mixture. The test liquid mixtures are prepared by mixing two liquids in various proportions. One liquid is nonpolar (test solvent A), and is a solvent for the asphaltenes in the deasphalting solvent. The other liquid is nonpolar (test solvent B), and is a nonsolvent for the asphaltenes in the deasphalting solvent. Test solvent A is typically toluene, and test solvent B is typically n-heptane.

A convenient volume ratio of oil to test liquid mixture is selected for the first test, for instance, 1 ml of oil to 5 ml of test liquid mixture. Then various mixtures of the test liquid mixture are prepared by blending n-heptane and toluene in various known proportions. Each of these is mixed with the deasphalting solvent at the selected volume ratio of deasphalting solvent to test liquid mixture. Then it is determined for each of these if the asphaltenes are soluble or insoluble. Any convenient method might be used. For example, a drop of the blend of test liquid mixture and deasphalting solvent can be observed between a glass slide and a glass cover slip using transmitted light with an optical microscope at a magnification of from 50 to 600×. If the asphaltenes are in solution, few, if any, dark particles will be observed. If the asphaltenes are insoluble, many dark, usually brownish, particles, usually 0.5 to 10 microns in size, will be observed. The results of blending deasphalting solvent with all of the test liquid mixtures are ordered according to increasing percent toluene in the test liquid mixture. The desired value will be between the minimum percent toluene that dissolves asphaltenes and the maximum percent toluene that precipitates asphaltenes. More test liquid mixtures are prepared with percent toluene in between these limits, blended with oil at the selected oil to test liquid mixture volume ratio, and determined if the asphaltenes are soluble or insoluble. The desired value will be between the minimum percent toluene that dissolves asphaltenes and the maximum percent toluene that precipitates asphaltenes. This process is continued until the desired value is determined within the desired accuracy. Finally, the desired value is taken to be the mean of the minimum percent toluene that dissolves asphaltenes and the maximum percent toluene that precipitates asphaltenes. This is the first datum point, $T_1$, at the selected oil to test liquid mixture volume ratio, $R_1$. This test is called the toluene equivalence test.

The second datum point can be determined by the same process as the first datum point, only by selecting a different volume ratio of deasphalting solvent to test liquid mixture. Alternatively, a percent toluene below that determined for the first datum point can be selected and that test liquid mixture can be added to a known volume of oil until asphaltenes just begin to precipitate. At that point the volume ratio of oil to test liquid mixture, $R_2$, at the selected percent toluene in the test liquid mixture, $T_2$, becomes the second datum point. Since the accuracy of the final numbers increase as the further apart the second datum point is from the first datum point, the preferred test liquid mixture for determining the second datum point is 0% toluene or 100% n-heptane. This test is called the heptane dilution test.

The insolubility number, $I_N$, is defined as:

$$I_N = T_2 - \left[\frac{T_2 - T_1}{R_2 - R_1}\right]R_2. \tag{1}$$

The solubility blending number, $S_{BN}$, is defined as:

$$S_{BN} = I_N\left[1 + \frac{1}{R_2}\right] - \frac{T_2}{R_2}. \tag{2}$$

Deasphalting Solvents without Asphaltenes

If the deasphalting solvent contains no asphaltenes, the Insolubility number is zero. However, the determination of the Solubility Blending Number for a deasphalting solvent not containing asphaltenes requires using a test oil containing asphaltenes for which the Insolubility Number and the Solubility Blending Numbers have previously been determined, using the procedure just described. First, 1 volume of the test oil is blended with 5 volumes of the deasphalting solvent. Insoluble asphaltenes may be detected by the microscope or spot technique, described above. If the oils are very viscous (greater than 100 centipoises), they may be heated to 100° C. during blending and then cooled to room temperature before looking for insoluble asphaltenes. Also, the spot test may be done on a blend of viscous oils in an oven at 50°-70° C. If insoluble asphaltenes are detected, the deasphalting solvent is a nonsolvent for the test oil and the procedure in the next paragraph should be followed. However, if no insoluble asphaltenes are detected, the deasphalting solvent is a solvent for the test oil and the procedure in the paragraph following the next paragraph should be followed.

If insoluble asphaltenes were detected when blending 1 volume of the test oil with 5 volumes of the deasphalting solvent, small volume increments of the deasphalting solvent are added to 5 ml of the test oil until insoluble asphaltenes are detected. The volume of nonsolvent oil, $V_{NSO}$, is equal to the average of the total volume of the deasphalting solvent added for the volume increment just before insoluble asphaltenes are detected and the total volume added when insoluble asphaltenes were first detected. The size of the volume increment may be reduced to that required for the desired accuracy. This is called the nonsolvent oil dilution test. If $S_{BNTO}$ is the Solubility Blending Number of the test oil and $I_{NTO}$ is the Insolubility Number of the test oil, then the Solubility Blending Number of the nonsolvent oil, $S_{BN}$, is given by.

$$S_{BN} = S_{BN} - \frac{S[S_{BNTO} - I_{NTO}]}{V_{NSO}}. \tag{3}$$

If insoluble asphaltenes were not detected when blending 1 volume of the test oil with 5 volumes of the deasphalting solvent, the deasphalting solvent is a solvent oil for the test oil. The same oil to test liquid mixture volume ratio, $R_{TO}$, as was used to measure the Insolubility Number and Solubility Blending Number for the test oil is selected. However, now various mixtures of the test liquid are prepared by blending different known proportions of the petroleum oil and n-heptane instead of toluene and n-heptane. Each of these is mixed with the test oil at a volume ratio of oil to test liquid mixture equal to $R_{TO}$. Then it is determined for each of these if the asphaltenes are soluble or insoluble, such as by the microscope or the spot test methods discussed previously. The results of blending oil with all of the test liquid mixtures are ordered according to increasing percent deasphalting solvent in the test liquid mixture. The desired value will be between the minimum percent petroleum oil that dissolves asphaltenes and the maximum percent deasphalting solvent that precipitates asphaltenes. More test liquid mixtures are prepared with percent deasphalting solvent in between these limits, blended with the test oil at the selected test oil to test liquid mixture volume ratio ($R_{TO}$) and determined if the asphaltenes are soluble or insoluble. The desired value will be between the minimum percent deasphalting solvent that dissolves asphaltenes and the maximum percent deasphalting solvent that precipitates asphaltenes. This process is continued until the desired value is determined within the desired accuracy. Finally, the desired value is taken to be the mean of the minimum percent deasphalting solvent that dissolves asphaltenes and the maximum percent deasphalting solvent that precipitates asphaltenes. This is the datum point, Tso, at the selected test oil to test liquid mixture volume ratio, $R_{TO}$. This test is called the solvent oil equivalence test. If $T_{TO}$ is the datum point measured previously at test oil to test liquid mixture volume ratio, $R_{TO}$, on the test oil with test liquids composed of different ratios of toluene and n-heptane, then the Solubility Blending Number of the deasphalting solvent, $S_{BN}$, is given by $$S_{BN} = 100\left[\frac{T_{TO}}{T_{SO}}\right]. \quad (4)$$

Mesophase Pitch Content Via Optical Microscopy

Unless otherwise specified herein, the mesophase pitch content of a sample is determined via optical microscopy in accordance with the following procedure. A digital image of the sample is generated using optical microscopy. A histogram of the total pixel count of the digital image is then prepared by color intensity, with lighter intensity regions corresponding to mesophase pitch due to its high refractivity. The image is divided into mesophase pitch and non-mesophase pitch areas via thresholding, with the area having an intensity less than a certain threshold corresponding to mesophase pitch. An estimate of the mesophase pitch content of the sample in % area (which result can then be extrapolated as corresponding to an estimate of % vol) is then obtained by subtracting out the non-mesophase pitch area of the image followed by dividing the total amount of the mesophase pitch area of the image by the total area of the image.

Certain aspects of the invention will now be described in more detail. Although the following description relates to particular aspects, those skilled in the art will appreciate that these are exemplary only, and that the invention can be practiced in other ways. References to the "invention" may refer to one or more, but not necessarily all, of the inventions defined by the claims. The use of headings is solely for convenience, and these should not be interpreted as limiting the scope of the invention to particular aspects.

Heavy Feedstock

In the processes of the present disclosure, the heavy feedstock may be characterized by boiling range. One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point for a feed is defined as the temperature at which 5 wt % of the feed will boil off. Similarly, a "T95" boiling point is a temperature at 95 wt % of the feed will boil. The percentage of a feed that will boil at a given temperature can be determined, for example, by the method specified in ASTM D2887 (or by the method in ASTM D7169, if ASTM D2887 is unsuitable for a particular fraction). Generally, the heavy feedstock may have a T5≥400° F. (204° C.) and a T95 of ≤1,400° F. (760° C.). Examples of such heavy feedstocks include those having a 1,050° F.+ (566° C.+) fraction. In some aspects, the 566° C.+ fraction can correspond to 1 wt % or more of the heavy feedstock (i.e., a T99 of 566° C. or higher), or 2 wt % or more (a T98 of 566° C. or higher), or 10 wt % or more (a T90 of 566° C. or higher), or 15 wt % or more (a T85 of 566° C. or higher), or 30 wt % or more (a T70 of 566° C. or higher), or 40 wt % or more (a T60 of 566° C. or higher), such as from about 1 wt % to about 40 wt % or about 2 wt % to about 30 wt %.

The heavy feedstock of the present disclosure may be characterized by reactivity as measured by its bromine number. The heavy feedstocks of the present disclosure may have a bromine number as measured in accordance with ASTM D1159 of ≥3, or ≥5, or ≥10, or ≥30, or ≥40, such as from about 3 to about 50, or from about 5 to about 40, or from about 10 to about 30.

The heavy feedstock of the present disclosure may be characterized by an aromatic content. The heavy feedstocks of the present disclosure can include about 40 mol % or more of aromatic carbons, or about 50 mol % or more, or about 60 mol % or more, such as up to about 75 mol % or possibly still higher. The aromatic carbon content of the heavy feedstock can be determined according to ASTM D5186.

The heavy feedstock of the present disclosure may be characterized by an average carbon number. The heavy feedstocks of the present disclosure may be composed of hydrocarbons having an average carbon number of about 33 to about 45 (e.g., about 35 to about 40, or about 37 to about 42, or about 40 to about 45).

The heavy feedstock of the present disclosure may be characterized by a micro carbon residue (MCR) as determined by ASTM D4530-15. The heavy feedstocks of the present disclosure may have an MCR of about 5 wt % or greater (e.g., about 5 wt % to about 45 wt %, or about 10 wt % to about 45 wt %).

The heavy feedstock of the present disclosure may be characterized by a hydrogen content. The heavy feedstocks of the present disclosure generally have a hydrogen content of about 6 wt % to about 11 wt %, such as from about 6 wt % to about 10 wt %.

The heavy feedstock of the present disclosure may be characterized by a cumulative concentration of polynuclear aromatic hydrocarbons (PNAs) and polycyclic aromatic hydrocarbons (PAHs). The feedstocks of the present disclosure may have a cumulative concentration of partially hydrogenated PNAs and partially hydrogenated PAHs of about 20 wt % or greater (e.g., about 50 wt % to about 90 wt %).

In some aspects, suitable heavy feedstocks can include about 50 wppm to about 10,000 wppm elemental nitrogen or more (i.e., weight of nitrogen in various nitrogen-containing compounds within the feedstock). Additionally or alternately, the heavy feedstock can include about 100 wppm to about 20,000 wppm elemental sulfur, preferably about 100 wppm to about 5,000 wppm elemental sulfur. Sulfur will usually be present as organically bound sulfur. Examples of such sulfur compounds include the class of heterocyclic sulfur compounds such as thiophenes, tetrahydrothiophenes, benzothiophenes and their higher homologs and analogs. Other organically bound sulfur compounds include aliphatic, naphthenic, and aromatic mercaptans, sulfides, and di- and polysulfides.

Examples of suitable heavy feedstocks include, but are not limited to, main column bottoms (MCB), steam cracker tar, vacuum resid, deasphalted residue or rock, hydroprocessed or hydrotreated forms of any of the foregoing, and combinations of any of the foregoing. A preferred heavy feedstock may be a hydroprocessed MCB. Another preferred example of heavy feedstock is a hydrotreated steam cracker tar. Steam cracker tar and subsequent hydrotreating can be produced/performed by any suitable method including for example, as disclosed in U.S. Pat. No. 8,105,479, which is incorporated herein by reference in its entirety.

Heat Treatment

In the processes of the present disclosure, the heavy feedstock is generally subjected to a heat treatment step to dealkylate and/or dehydrogenate the heavy feedstock and produce an isotropic pitch. As described above, without wishing to be bound by theory, it is believed that conducting the heat treatment step under conditions of sufficiently high severity in relation to the reactivity of the feedstock advantageously results in the formation of mesogens in the resulting isotropic pitch that can then develop into mesophase agglomerates through solvent extraction. Often, such conditions are higher severity than those employed in visbreaking. More particularly, generally, the heat treatment may be conducted at a temperature ranging from about 420° C. to about 520° C., preferably from about 480° C. to about 510° C. and a residence time ranging from about 5 minutes to 8 hours, more preferred from about 5 minutes to about an hour, and most preferred from about 5 minutes to about 30 minutes, such as about 10 minutes to about 30 minutes. Generally, the requisite severity of the heat treatment step is dependent on the bromine number of the heavy feedstock. Typically, the requisite severity of the heat treatment conditions increases as the bromine number of the heavy feedstock decreases. Generally, the heat treatment is conducted under conditions sufficient to satisfy the relationship [X*Y]≥20,000 seconds (e.g., ≥30,000 seconds, or ≥50,000 seconds, or ≥70,000 seconds or ≥200,000 seconds, or ≥500,000 seconds, or ≥700,000 seconds) wherein X is the equivalent reaction time of the heating, and wherein Y is the bromine number of the feedstock. For example, [X*Y] may range from about 20,000 to about 1,000,000 seconds, such as from about 30,000 seconds to about 700,000 second, or from about 50,000 seconds to about 500,000 seconds, or from about 50,000 seconds to about 100,000 seconds. For example, in embodiments where the heavy feedstock has a bromine number ≥10, the minimum ERT of the heat treatment step may be about 2,000 seconds or less, such as a minimum ERT of 500 seconds. In embodiments where the heavy feedstock has a bromine number <10, the minimum ERT of the heat treatment step may be greater than about 2,000 seconds, such as a minimum ERT of 10,000 seconds, or alternatively, a minimum ERT of 8,000 seconds.

Suitable pressures of the heat treatment step may range from about 200 psig (1,380 kPa-g) to about 2,000 psig (13,800 kPa-g), such as from about 400 psig (2,760 kPa-g) to about 1,800 psig (12,400 kPa-g). The heat treatment may be conducted in any suitable vessel, such as a tank, piping, tubular reactor, or distillation column. An example of a suitable reactor configuration that may be employed to conduct the heat treating is described U.S. Pat. No. 9,222,027, which is incorporated herein by reference in its entirety.

Generally, the heat treated product is a liquid. In certain aspects, the heat treated product may be further processed to produce the isotropic pitch described herein, such as via flashing, distillation, fractionation, another type of separation based on boiling range, etc., preferably vacuum distillation. For example, often the heat treated product will contain one or more light fractions containing diesel and/or gasoline components and a heavy fraction containing the isotropic pitch described herein. In such aspects, the yield of the heavy, isotropic pitch containing fraction is typically greater than about 50 wt % of the heat treated product, such as greater than about 60 wt %, preferably greater than about 80 wt %.

Isotropic Pitch

The resultant isotropic pitch obtained from the heat treatment (and optional subsequent separation step(s)) may be characterized by a micro carbon residue (MCR) as measured in accordance with ASTM D4530-15. Generally, the isotropic pitch of the present disclosure may have an MCR of 30 wt % or greater (e.g., preferably about 50 wt % or greater, even more preferably about 60 wt % or greater). For example, suitable isotropic pitch may have an MCR ranging from about 30 wt % to about 90 wt %, preferably from about 50 wt % to about 90 wt %, even more preferably from about 60 wt % to about 90 wt %. Typically, the isotropic pitch has an MCR at least 5% greater than that of the heavy feedstock, such as at least 10% greater, more preferably at least 20% greater.

The isotropic pitch of the present disclosure may be characterized by a softening point as measured in accordance with ASTM D3104-14. Generally, the isotropic pitch of the present disclosure may have a softening point of about 80° C. or greater, preferably about 100° C. or greater, more preferably about 120° C. or greater, even more preferably about 200° C. (e.g., preferably ranging from about 80° C. to about 250° C., more preferably ranging from about 100° C. to about 250° C., even more preferably from about 150° C. to about 250° C.).

The isotropic pitch of the present disclosure may be characterized by a quinoline insoluble content as measured in accordance with ASTM D2318-15. Generally, the isotropic pitch of the present disclosure may have a quinoline insoluble content of about 1 wt % or greater (e.g., preferably about 2 wt % or greater, even more preferably about 5 wt % or greater, such as from about 1 wt % to about 10 wt %).

The isotropic pitch of the present disclosure may be characterized by a mesophase pitch content. Often, the isotropic pitch of the present disclosure may have a mesophase pitch content of greater than about 0.5 wt % and/or greater than about 0.5 vol % as measured in accordance with ASTM D4616-95(2018), such as from about 0.5 wt % to about 1 wt %. Alternatively, the isotropic pitch of the present disclosure may have a mesophase pitch content of less than 0.5 wt %, such as about 0 wt % or about 0 vol % as measured in accordance with ASTM D4616-95(2018).

The isotropic pitch of the present disclosure may be characterized by a hydrogen content. Generally, the isotropic pitch of the present disclosure may have a hydrogen content less than about 8 wt % (e.g., preferably about 6 wt % or less, such as from about 4 wt % to about 6 wt %).

The isotropic pitch of the present disclosure may be characterized by a sulfur content. Generally, the isotropic pitch of the present disclosure may have a sulfur content of less than about 2 wt % (e.g., preferably about 1 wt % or less, even more preferably about 0.5 wt % or less), such as from about 0 wt % to about 2 wt %.

Deasphalting Solvent

In the processes of the present disclosure, a suitable deasphalting solvent can be selected based on its Solubility Blending Number ($S_{BN}$). Typically, the deasphalting solvent has an $S_{BN}$ of least about 10 solvency units ("SU"). For example, suitable deasphalting solvents may have an $S_{BN}$ from about 10 to about 150 SU, such as from about 10 to about 130 SU, or from about 10 to about 70 SU, or from about 10 to about 50 SU, or from about 70 to about 130 SU.

The deasphalting solvent of the present disclosure may be characterized by a boiling range. In some aspects, the deasphalting solvent can have an atmospheric boiling range of roughly 65° C. to 200° C., such as from about 100° C. to about 175° C. Advantageously, the atmospheric boiling range of the deasphalting solvent may be less than about 200° C. to facilitate recovery of the solvent from the extraction process described herein, such via distillation.

Examples of suitable deasphalting solvents include, but are not limited to, $C_2$-$C_{10}$ paraffins, such as pentane, heptane, and butane; single ring aromatics such as toluene, xylene, ethylbenzene, and trimethylbenzene; multi-ring aromatics, such as naphthalene, methylnaphthalene, indan, tetralin, and anthracene; aromatics including a heteroatom such as pyridine; other heteroatom compounds such as tetrahydrofuran; heavy naphtha, kerosene, and/or light diesel fractions; a recycled portion of a product generated during upgrading of a heavy oil feedstock, such as steam cracker tar; and other hydrocarbon or hydrocarbon-like fractions having a suitable boiling range. When a recycled portion of a product generated during upgrading of steam cracker tar is included in the deasphalting solvent, the distillation cut points for the recycled portion can be adjusted to provide a suitable boiling range and/or a suitable $S_{BN}$. Typically, a suitable atmospheric boiling range for the recycled portion ranges from about 350° F. (177° C.) to about 850° F. (454° C.), i.e., a midcut solvent. Preferred heavy oil feedstock upgrading processes for obtaining a midcut solvent are further described in US Pat. Pub. No. 2020/0071627, which is incorporated herein by reference in its entirety. In some aspects, a paraffin such as hexane or heptane may be included as a co-solvent to modify the solubility parameter of a solvent mixture, preferably in an amount up to about 90 vol % based on the total volume of the solvent, such as about 10 vol %. For example, preferred deasphalting solvents may include from about 0 to about 90 vol % of a paraffin, e.g. n-heptane, and from about 10 to about 100 vol % toluene, such as 90 vol % toluene and 10 vol % n-heptane or alternatively 80 vol % toluene and 20 vol % n-heptane, or alternatively 70 vol % toluene and 30 vol % n-heptane, or yet alternatively 10 vol % toluene and 90 vol % n-heptane. Examples of preferred deasphalting solvents with their associated $S_{BN}$ values are depicted in Table 1.

TABLE 1

| Solvent | $S_{BN}$ (SU) |
|---|---|
| toluene | 100 |
| single ring aromatics | 90-100 |
| two-ring aromatics | ~120 |
| 10 vol %:90 vol % n-heptane:toluene | 90 |
| 20 vol %:80 vol % n-heptane:toluene | 80 |
| 70 vol %:30 vol % n-heptane:toluene | 30 |
| 90 vol %:10 vol % n-heptane:toluene | 10 |
| midcut solvent | 100-120 |
| 30 vol %:70 vol % n-heptane:midcut solvent | 70-84 |

Solvent Extraction

In the processes of the present disclosure, typical solvent extraction conditions include mixing the isotropic pitch with the deasphalting solvent in a volume ratio (deasphalting solvent:isotropic pitch) of from about 10:1 to about 1:1, such as about 8:1 or less. Typically, the extraction is conducted under conditions suitable to maintain the solvent in the liquid phase. For example, the extraction may preferably be carried out under extraction conditions which include a temperature in the range of from about 90° C. to about 350° C., preferably about 150° C. to about 350° C., even more preferably about 200° C. to about 350° C.; a total pressure in the range of from about 15 psig (~105 kPa-g) to about 800 psig (~5,600 kPa-g); and a residence time from about 5 minutes to about 5 hours. Typically, the extraction may be conducted under agitation, such as mechanical agitation using a rotating stirrer. Suitable agitation rates may range from about 10 RPM to about 8,500 RPM, such as from about 50 RPM to about 5,000 RPM.

Contacting the isotropic pitch with the deasphalting solvent produces at least two types of product streams. One type of product stream can be a solvent phase fraction that includes a majority of the deasphalting solvent and a majority of the portions of the heat treated product or resultant separated heavy fraction that are soluble in the deasphalting solvent. At least a portion of the deasphalting solvent is typically recovered from the solvent phase fraction, such as by distillation, for recycle and re-use of the recovered deasphalting solvent for the solvent extraction. The portion of the solvent phase resulting after recovery of the deasphalting solvent generally comprises a supplemental pitch product, otherwise known as deasphalted oil (DAO), that may optionally be recycled to the heat treatment step. An insoluble fraction (the second type of product stream), otherwise known as rock, includes the remaining portion of the isotropic pitch, namely the portion that is not soluble in the deasphalting solvent. Generally, the insoluble fraction comprises mesophase pitch as well as entrained residual solvent and mesophase pitch precursors. Optionally, the softening point of the insoluble fraction may be lowered by mixing the insoluble fraction with a low softening point isotropic pitch (e.g., <200° C.) or low boiling point solvent (e.g., having an atmospheric boiling point ranging from about 200° F. (93.3° C.) to about 650° F. (343° C.). In such aspects, the low softening point isotropic pitch or low boiling point solvent may be admixed with the insoluble fraction in an amount ranging from about 10 vol % to about 60 vol % based on the total volume of the mixture, more preferably from about 10 vol % to about 40 vol %, even more preferably from about 10 vol % to about 20 vol %. Additionally or alternatively, the insoluble fraction may undergo a subsequent heat treatment step to convert the remaining mesophase precursors into mesophase pitch. The optional heat treatment step may be conducted at a temperature ranging from about 300° C. to about 350° C., and may be carried out in the presence of a solvent, preferably a low boiling point solvent (e.g., having an atmospheric boiling point ranging from about 200° F. (93.3° C.) to about 650° F. (343° C.). Any convenient form of separation can be used for removing residual solvent from the insoluble fraction, e.g., one or more of drying, distillation, fractionation, another type of separation based on boiling range, etc. Optionally, the resulting recovered residual solvent may be recycled and re-used for the solvent extraction. Generally, the yield of the remaining solid product recovered from the insoluble fraction after the residual solvent has been removed obtained is at least about 10 wt %, preferably at least about 15 wt %, such as from about 10 wt % to about 50 wt %, or from about 20 wt % to about 40 wt %. The recovered solid product typically comprises about 30 vol % or more of an optically active fraction, such as from about 30 vol % to about 95 vol % or from about 50 vol % to about 85 vol %. In some aspects, the amount of quinoline-insoluble content in the recovered solid product can be about 75 wt % or less, or about 50 wt % or less, or about 30 wt % or less, such as from about 0 wt % to about 30 wt %. Additionally or alternatively, the amount of toluene-insoluble content in the recovered solid product can be about 80 wt % or less, or about 60 wt % or less, or about 40 wt % or less, or about 30 wt % or less, such as from about 0 wt % to about 30 wt %.

Carbon Fiber

The mesophase pitch obtained from the solvent extraction processes described herein can be used to form carbon fibers, such as by using a conventional melt spinning process. Melt spinning for formation of carbon fiber is a known technique. For example, the book "Carbon-Carbon Materials and Composites" includes a chapter by D. D. Edie and R. J. Diefendorf titled "Carbon Fiber Manufacturing." Another example is the article "Melt Spinning Pitch-Based Carbon Fibers", Carbon, 27(5), p 647, (1989).

Process Overview

The processes disclosed herein may be batch, semi-batch, continuous, semi-continuous processes, or any combination thereof, preferably continuous processes. FIG. 1 shows an overview of a non-limiting example process 100 of the instant disclosure. A heavy feedstock 102 is subjected to a heat treatment step in vessel 104 under conditions sufficient to satisfy the relationship the relationship [X*Y]≥20,000 seconds, wherein X is the equivalent reaction time of the heating, and wherein Y is the bromine number of the feedstock 102. The heat treatment step carried out in vessel 104 results in formation of a heat treated product 106 comprising isotropic pitch. Often (though not required), the heat treated product 106 can undergo a separation step to form heavy fraction 108 comprising isotropic pitch and a light fraction 110. Optionally, the light fraction 110 can be blended with fuel oil. The resultant heat treated product 106 or heavy fraction 108 is passed into a solvent extractor 112, along with a deasphalting solvent 114. This results in formation of a solvent phase fraction 116 that includes a majority of deasphalting solvent 114 and a majority of the portions of heat treated product 106 or heavy fraction 108 that are soluble in the deasphalting solvent 114. An insoluble fraction 118, i.e., rock, including a majority of the insoluble portion of the heat treated product 106 or heavy fraction 108 is also formed. Generally, the insoluble fraction 118 comprises mesophase pitch as well as entrained residual solvent and mesophase pitch precursors. Often (though not required), as described herein, the insoluble fraction 118 may undergo a subsequent heat treatment step (not shown) to convert the remaining mesophase precursors into mesophase pitch and/or a mixing step (not shown) to lower the softening point of the insoluble fraction 118. Often (though not required), a portion of solvent phase fraction 116 can undergo a separation step to form a recovered solvent stream 122 and a deasphalted oil (DAO) 120. Optionally, at least a portion of the recovered deasphalting solvent stream 122 may be recycled to solvent extractor 112, either in combination with deasphalting solvent stream 112 or via a separate stream. Additionally, optionally at least a portion of the DAO 120 and/or at least a portion of the insoluble 118 may be recycled to vessel 104, either in combination with heavy feedstock 102 or via a separate stream.

The following examples illustrate the present invention. Numerous modifications and variations are possible and it is to be understood that within the scope of the appended claims, the invention may be practiced otherwise than as specifically described herein.

EXAMPLES

Example 1: Preparation of Isotropic Pitch

Five example isotropic pitches (Pitch A, Pitch B, Pitch C, Pitch D, and Pitch E) and one comparative example isotropic pitch (Pitch F) were prepared via heat treating a heavy feedstock having the properties summarized in Table 2 at the conditions summarized in Table 3. For Pitch A and Pitch B (but not Pitch C, Pitch D, Pitch E, or Pitch F), the heat treatment was followed by separation of a heavy fraction via vacuum distillation. The heavy feedstock used for Pitch A and B was a product generated via upgrading of a steam cracker tar in accordance with methods described in US Pat. Pub. No. 2020/0071627, the heavy feedstock used for Pitch C, Pitch D, and Pitch F was a hydroprocessed MCB, and the heavy feedstock used for Pitch E was a (non-hydroprocessed) MCB.

TABLE 2

Properties of Heavy Feedstock used to Produce Pitch A-F

| | Pitch A | Pitch B | Pitch C | Pitch D | Pitch E | Pitch F (Comp. Ex) |
|---|---|---|---|---|---|---|
| Atmospheric boiling point (° F.) | >650 | >650 | — | — | — | — |
| Bromine number | <5 | <5 | 10.1 | 10.1 | 31.7 | 10.1 |
| Softening point (° C.) | <30 | <30 | <30 | <30 | <30 | <30 |
| Hydrogen content (wt %) | 8 | 8 | 8.5 | 8.5 | 7.96 | 8.5 |
| Sulfur content (wt %) | 0.6 | 0.6 | 0.3 | 0.3 | 1.87 | 0.3 |
| Micro carbon residue (%) | 15.3 | 15.3 | 4 | 4 | 5.8 | 4 |

TABLE 3

Heat Treatment Conditions

| | Temperature (° C.) | Pressure (psig) | Residence Time (hr) | ERT (s) | ERT × Bromine Number (s) |
|---|---|---|---|---|---|
| Pitch A | 500 | 1000 | 0.3 | 4800 | 24000 |
| Pitch B | 520 | 1000 | ~0.15 | 5800 | 29000 |
| Pitch C | 430 | 1000 | 6 | 3000 | 30300 |
| Pitch D | 470 | 1000 | 1 | 3900 | 39,400 |
| Pitch E | 460 | 1000 | 1 | 2380 | 75,400 |
| Pitch F (Comp. Ex.) | 440 | 1000 | 1 | 845 | 8530 |

Figure 2:
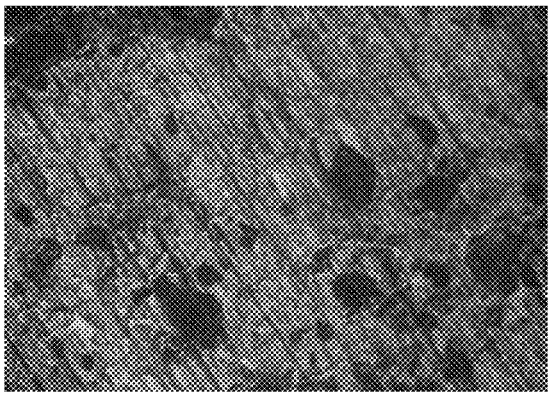
FIG. 2 is an optical polarized light micrograph of the isotropic pitch (Pitch A) used to conduct Example 2.
Figure 3:
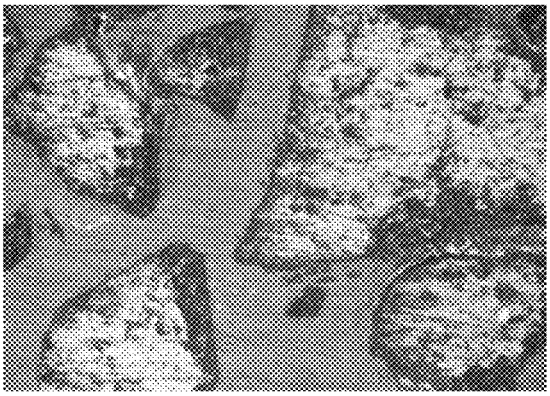
FIG. 3 is an optical polarized light micrograph of the isotropic pitch (Pitch B) used to conduct Example 3.

FIGS. 2 and 3 depict optical micrographs of Pitch A and Pitch B, respectively. As can be seen from these Figures, little or no mesophase was observed. Table 4 depicts the properties of the resulting example isotropic pitches (Pitch A-E) and the comparative example pitch (Pitch F).

TABLE 4

Isotropic Pitch Properties

| | Pitch A | Pitch B | Pitch C | Pitch D | Pitch E | Pitch F |
|---|---|---|---|---|---|---|
| Micro Carbon Residue (MCR) (%) | 58.9 | 70.2 | 42.5 | 68 | 49 | 13.1 |
| Softening Point (° C.) | 121 | 200.5 | 81.3 | 73.2 | 91.6 | <30 |
| Real Density in Helium (kg/dm$^3$) | 1.258 | — | — | — | — | — |
| Hydrogen content (wt %) | 5.2 | — | — | — | 4.2 | 7.2 |
| Sulfur content (wt %) | 0.74 | — | — | — | 2.2 | 0.33 |
| Toluene Insoluble (wt %) | 18.8 | — | — | — | — | — |
| Quinoline Insoluble (wt %) | 1.0 | — | — | — | — | — |
| Ash Content (wt %) | 0.03 | — | — | — | — | — |
| Mesophase Pitch Content (wt %) | 0 | 0-0.5 | <1 | 0 | 0 | 0 |

As can be seen from Table 4, Pitch A and Pitch C exhibited a moderate MCR, while Pitch B and Pitch D exhibited a high MCR. These results were expected given the higher severity of the heat treatment conditions used to form Pitch B and Pitch D in comparison to Pitch A and Pitch C.

Examples 2-6 & Comparative Example: Solvent Extraction of Isotropic Pitch

In each of Examples 2-6 and the Comparative Example, the isotropic pitch (Pitch A, Pitch B, Pitch C, Pitch D, Pitch E, or Pitch F, respectively) was introduced into a 500 ML Hastelloy™ C276 autoclave after which toluene, i.e., a deasphalting solvent having an $S_{BN}$ of 100 SU, was introduced at a ratio of 8 ml toluene per gram of isotropic pitch. The resulting mixture was sealed in the autoclave and placed under an inert nitrogen environment.

The solvent extraction process was carried out in the autoclave under autogenous pressure at 230° C. for Examples 2, 3, and 6, and at 280° C. for Examples 4, 5, and the Comparative Example. The solvent/isotropic pitch mixture was stirred for 1 hour for Exs. 2, 3, 4, and 6, 85 min for Ex. 5, and 3 hours for the Comparative Example, in each case followed by cooling down to room temperature. During the course of the extraction, a pressure of 160 psig and 350 psig developed for the runs carried out at 230° C. and 280° C., respectively. The insoluble phase fraction (if any) was collected after decanting the solvent phase fraction and subsequently dried for 30 minutes to remove residual solvent and produce a recovered solid product.

As depicted in FIG. 1 and FIG. 2, little or no mesophase pitch was observed in the isotropic pitch, thereby substantiating the formation of mesophase pitch during the solvent extraction process.

Figure 4:
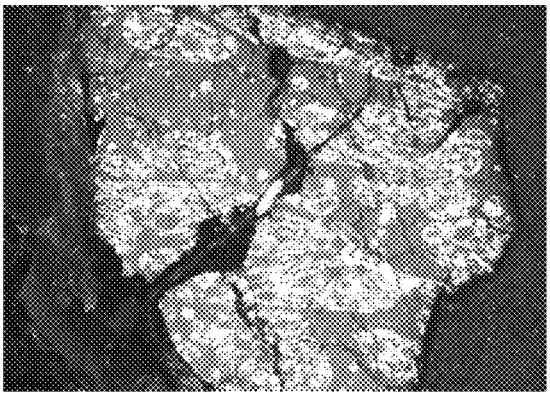
FIG. 4 is an optical polarized light micrograph of the solid product recovered in Example 2.
Figure 5:
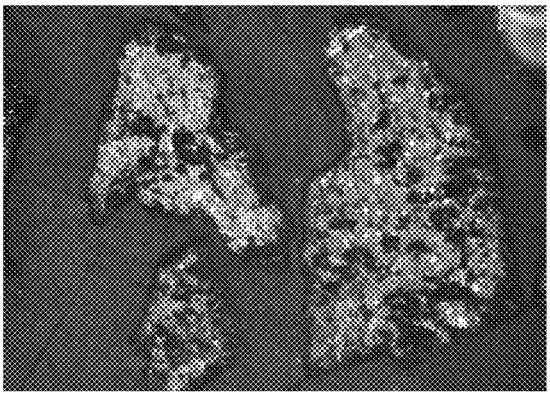
FIG. 5 is an optical polarized light micrograph of the solid product recovered in Example 3.

FIGS. 4 and 5 depict optical micrographs of the recovered solid product from Example 2 and 3, respectively. The results of the recovered solid product for each of Ex.2-6 and the Comparative Example are summarized in Table 5.

TABLE 5

| Recovered Solid Product | | | | | | |
|---|---|---|---|---|---|---|
| Isotropic Pitch | Ex.2 Pitch A | Ex. 3 Pitch B | Ex. 4 Pitch C | Ex. 5 Pitch D | Ex. 6 Pitch E | Comp. Ex. Pitch F |
| Yield (wt %) | 30 | 44 | 23 | 30 | 26 | 0 |
| Micro Carbon Residue (MCR) (%) | 76 | 75 | 86.2 | 84.3 | — | — |
| Optically Active Fraction (area %) | 75 | 30 | >95 | 30-40 | >75 | — |

As can be seen from Table 5, a solid product was recovered in each of Ex. 2-6 but not the Comparative Example. These results were expected given the higher ERT×Bromine Number values for each of Pitch A-E in comparison to Pitch F.

Example 7: Solvent Extraction of Isotropic Pitch with 10 SU Deasphalting Solvent In Example 7, an isotropic pitch was prepared via heat treating a fluxed tar heavy feedstock having the following properties: an MCR of 24.2%, a hydrogen content of 6.9 wt %, and a bromine number of around 40. The heat treatment was conducted at the following conditions: a temperature of 460° C.; a pressure of 1,000 psig; a residence time of 35 minutes; and an ERT of 1,387 seconds. The resulting isotropic pitch exhibited the following properties: an MCR of 35.1%; a hydrogen content of 5.32 wt %; a softening point of <30° C.; and a mesophase pitch content of 0 vol %.

The obtained isotropic pitch was introduced into a 500 ML Hastelloy™ C276 autoclave after which a 90 vol %:10 vol % n-heptane:toluene mixture, i.e., a deasphalting solvent having an $S_{BN}$ of 10 SU, was introduced at a ratio of 8 ml solvent per gram of isotropic pitch. The resulting mixture was sealed in the autoclave and placed under an inert nitrogen environment.

The solvent extraction process was carried out in the autoclave under autogenous pressure at 280° C. The solvent/isotropic pitch mixture was stirred for 1 hour and then cooled to room temperature. During the course of the extraction, a pressure 350 psig developed. The insoluble phase fraction was collected after decanting the solvent phase fraction and subsequently dried for 30 minutes to remove residual solvent and produce a recovered solid product.

The resulting recovered solid product exhibited the following properties: a yield of 21 wt %; an optically active fraction of 90 area %; and a softening point of >400° C. These results demonstrate that a deasphalting solvent having an $S_{BN}$ of 10 SU was effective in yielding a solid product comprising mesophase pitch.

All documents described herein are incorporated by reference herein, including any priority documents and/or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby. Likewise, the term "comprising" is considered synonymous with the term "including" for purposes of United States law. Likewise whenever a composition, an element or a group of elements is preceded with the transitional phrase "comprising", it is understood that it is also contemplated that the same composition or group of elements with transitional phrases "consisting essentially of," "consisting of", "selected from the group of consisting of," or "is" preceding the recitation of the composition, element, or elements and vice versa.

What is claimed is:

1. A process for producing mesophase pitch, the process comprising:

providing a feedstock having a T5>400° F. (204° C.) and a T95≤1,400° F. (760° C.);

configuring conditions for a heat treatment of the feedstock that satisfy a relationship [X*Y]≥20,000 seconds, wherein X is an equivalent reaction time (ERT) of the heat treatment, and wherein Y is a bromine number of the feedstock as measured in accordance with ASTM DI 159;

heating the feedstock at the conditions, wherein the conditions comprise a temperature ranging from about 420° C. to about 520° C. to produce a heat treated product including isotropic pitch;

contacting the isotropic pitch with a solvent having a Solubility Blending number ($S_{BN}$) of at least about 10 SU under conditions sufficient to produce a solvent fraction comprising the solvent and an insoluble fraction comprising mesophase pitch; and recovering the mesophase pitch.

2. The process of claim 1, wherein the feedstock has a bromine number ≥10, and wherein the heating is conducted at an ERT of at least about 2,000 seconds.

3. The process of claim 1, wherein the feedstock has a bromine number <10, and wherein the heating is conducted at ERT of at least about 4,000 seconds.

4. The process of claim 1, wherein the heating is conducted at a temperature ranging from about 420° C. to about 510° C.

5. The process of claim 1, wherein the feedstock comprises a fraction having a boiling point of 1,050° F. (566° C.) ranging from about 1 wt % to about 40 wt % based on the weight of the feedstock.

6. The process of claim 1, wherein the feedstock comprises at least one member selected from the group consisting of main column bottoms (MCB), hydroprocessed MCB, steam cracker tar, hydrotreated steam cracker tar, vacuum resid, deasphalted residue or rock, and mixtures or combinations thereof.

7. The process of claim 1, wherein the isotropic pitch has at least one of the following properties:

(a) a micro carbon residue (MCR) as measured in accordance with ASTM D4530-15 ranging from about 30% to about 90%;

(b) a softening point as measured in accordance with ASTM D3104-14 ranging from about 80° C. to about 250° C.;

(c) a mesophase pitch content as measured in accordance with ASTM D4616-95 (2018) of greater than about 0.5 vol %; and (d) a quinoline insoluble content as measured in accordance with ASTM D2318-15 of greater than about 1 wt %.

8. The process of claim 7, wherein the isotropic pitch has a micro carbon residue (MCR) as measured in accordance with ASTM D4530-15 of at least about 60%.

9. The process of claim 1, further comprising separating the heat treated product to produce a heavy fraction comprising the isotropic pitch and a light fraction.

10. The process of claim 1, wherein the insoluble fraction comprises a residual amount of the solvent, and wherein recovering the mesophase pitch comprises removing at least a portion of the residual solvent to form a recovered solid product, and wherein the yield of the recovered solid product is at least about 10%, and wherein the recovered solid product comprises at least about 30 vol % of an optically active fraction.

11. The process of claim 1, wherein the ratio of the isotropic pitch to the solvent during the contacting ranges from about 10:1 to about 1:1 by volume.

12. The process of claim 1, wherein the solvent has an $S_{BN}$ ranging from about 10 SU to about 130 SU.

13. The process of claim 1, wherein the solvent has an $S_{BN}$ ranging from about 10 SU to about 100 SU.

14. The process of claim 1, wherein the solvent is selected from the group consisting of single-ring aromatics, two-ring aromatics, paraffins, a midcut solvent, and mixtures or combinations thereof, and wherein the solvent comprises from about 10 to about 100 vol % single ring aromatics and from about 0 to about 90 vol % n-heptane based on the volume of the solvent.

15. The process of claim 1, wherein the contacting is carried out at a temperature ranging from about 90° C. to about 350° C.

16. The process of claim 1, wherein the contacting is carried out at a temperature ranging from about 150° C. to about 350° C., a pressure ranging from about 15 psig to about 800 psig, and a residence time from about 5 minutes to about 5 hours.

17. The process of claim 1, further comprising separating the solvent phase to form a recovered solvent stream and a deasphalted oil stream.

18. The process of claim 17, further comprising recycling at least a portion of the recovered solvent stream to the solvent extraction, and further comprising recycling at least a portion of the deasphalted oil stream to the heat treating.

19. A carbon fiber produced from the mesophase pitch of claim 1.

20. A process for producing mesophase pitch, the process comprising:

providing a feedstock comprising at least one member selected from the group consisting of main column bottoms (MCB), hydroprocessed MCB, steam cracker tar, hydrotreated steam cracker tar, vacuum resid, deasphalted residue or rock, and mixtures or combinations thereof;

configuring conditions for a heat treatment of the feedstock that satisfy a relationship [X*Y]≥20,000 seconds, wherein X is an equivalent reaction time (ERT) of the heat treatment, and wherein Y is a bromine number of the feedstock as measured in accordance with ASTM DI 159;

heating the feedstock at the conditions, wherein the conditions comprise a temperature ranging from about 420° C. to about 520° C. to produce a heat treated product including isotropic pitch;

contacting the isotropic pitch with a solvent selected from the group consisting of single-ring aromatics, two-ring aromatics, paraffins, a midcut solvent, and mixtures or combinations thereof under conditions sufficient to produce a solvent fraction comprising the solvent and an insoluble fraction comprising mesophase pitch; and recovering the mesophase pitch.

* * * * *